United States Patent [19]

Hennessy

[11] 4,404,824

[45] Sep. 20, 1983

[54] SIDE-BAR LOCK

[75] Inventor: Thomas F. Hennessy, Bristol, Conn.

[73] Assignee: Lori Corporation, Southington, Conn.

[21] Appl. No.: 231,777

[22] Filed: Feb. 5, 1981

[51] Int. Cl.[3] ..... E05B 27/06

[52] U.S. Cl. ..... 70/364 A; 70/419; 70/358

[58] Field of Search ..... 70/358, 364 R, 364 A, 70/365, 366, 416, 419, 421

[56] References Cited

U.S. PATENT DOCUMENTS

| | | | |
|---|---|---|---|
| 2,648,973 | 8/1953 | Spain | 70/366 |
| 2,690,070 | 9/1954 | Spain | 70/421 |
| 3,479,849 | 11/1969 | Check | 70/364 A |
| 3,837,197 | 9/1974 | Lopez | 70/364 A |
| 3,857,263 | 12/1974 | Garther | 70/364 A |

FOREIGN PATENT DOCUMENTS

| | | | |
|---|---|---|---|
| 2055948 | 3/1981 | United Kingdom | 70/358 |

*Primary Examiner*—Robert L. Wolfe

[57] ABSTRACT

A compact cylinder lock operated by a key having smooth edges and detents in opposed side faces. The locking mechanism includes series connected pin tumblers and side bars which are resiliently biased. A resiliently biased fence cooperates with the side bars and lock housing; the fence moving out of engagement with the housing and into gates in the side bars when the side bars are moved a sufficient distance by the pin tumblers.

19 Claims, 5 Drawing Figures

SIDE-BAR LOCK

BACKGROUND OF THE INVENTION (1) Field of the Invention

The present invention is directed to the field of cylinder locks and particularly to side bar type locks Specifically, the present invention relates to reducing the size and manufacturing cost of cylinder locks without sacrificing the security provided thereby. Accordingly, the general objects of the present invention are to provide novel and improved devices and methods of such character.

(2) Description of the Prior Art

Various types of cylinder locks are known in the prior art. Cylinder locks are comprised of a key plug rotatably mounted within a cylinder. Normally the locking mechanism prevents rotation of the key plug. The locking mechanisms of prior cylinder locks may be generally characterized as having either tumblers or side bars. These types of locking mechanisms function along similar principles.

Tumbler type locking mechanisms are comprised of a plurality of tumblers reciprocally mounted within the key plug. The tumblers, which may be in the form of pins, are typically spring biased across the shear line between the key plug and the cylinder so as to normally engage the cylinder. This prevents the key plug from rotating within the cylinder. However, one type of prior art tumbler locking mechanism incorporates pin type tumblers associated with cylinder mounted drivers which are biased against the tumblers. These drivers are of cylindrical shape as are the pin tumblers. The drivers, not the tumblers, are normally biased across the shear line. The drivers and tumblers may be separated across the shear line by a properly fitted key; the key conventionally having a plurality of cuts at different levels. These cuts urge the tumblers against the drivers causing the two to be separated across the shear line thereby allowing the key plug to be rotated.

Another tumbler type locking mechanism incorporates flat slidable tumblers which are biased cross the shear line. These flat tumblers are provided with posts at varying positions along their length which, when contacted by properly formed key cuts, urge the tumbler across the shear line so that the key plug may be rotated.

Side bar type locking mechanisms incorporate a slidable fence which is positioned within a lateral slot of the key plug and is normally biased into engagement with the cylinder to prevent the key plug from rotating. The individual tumblers, which are reciprocally mounted within the key plug and also engage the cylinder, are provided with grooves or true gates at different locations. These true gates are capable of receiving the fence when in alignment therewith. When all the tumblers are properly positioned by the keys, and thus retracted from engagement with the cylinder, the fence is in alignment with all the true gates. Rotation of the key plug forces the fence to engage the true gates and thus release the lock. The proper positioning of each tumbler is produced by a key which has properly fitted key cuts at the required levels.

One specific class of prior art cylinder lock which utilizes drivers and pin tumblers is generally referred to as the KABA lock. In KABA type locks the key is provided with detents instead of key cuts. These detents are depressions within the opposed side surfaces of the key that have a proper depth to correctly position the tumblers. The use of KABA type locks is attractive because the key has detents instead of cuts which eliminates the sharp cutting edges.

It has also been proposed to fabricate cylinder locks which employ both pin-type tumblers and side bars; the two locking mechanisms being separately activated by a complex key having key cuts with angled surfaces. These locks are, however, quite complex and thus relatively expensive.

The above-discussed prior art cylinder locks have had one or more disadvantages. For example, locking mechanisms which incorporate drivers and pin tumblers are susceptible to tampering. The susceptibility to being defeated results from the fact that manufacturing tolerances result in the key plug being rotatable a limited distance within the cylinder. This creates a shoulder at the shear line. When the drivers are moved past the shear line they are caught by this shoulder. By minutely rotating the plug and pushing the drivers outward from the keyway all the drivers may be caught and the plug fully rotated to open the lock.

A major disadvantage with cylinder locks incorporating either tumbler or side bar locking mechanisms resides in the comparatively high manufacturing cost. In order to provide numerous key changes in locks employing tumbler type locking mechanisms numerous sizes of pin tumblers and drivers must be manufactured or numerous flat tumblers having posts positioned at different positions along their lengths must be provided. Similiarly, to provide for key changes in the case of side bar locking mechanisms numerous tumblers having true gates positioned at differing locations must be manufactured. The requirement of manufacturing and stocking many different tumblers greatly increases the cost of each individual lock.

The prior art KABA locks only incorporate locking mechanisms which use driver and pin tumbler arrangements. As stated above locks which incorporate drivers and pin tumblers are subject to tampering and have disadvantageous manufacturing costs. Further, these prior art KABA locks are relatively large in size since bores must be provided within the lock cylinder in order to accomodate the drivers and springs. Thus the usefulness of prior art KABA locks is limited by the driver and pin tumbler locking mechanism.

An additional disadvantage shared by prior side-bar type locks and locks of the KABA type resides in the inability to remove the key at any rotational position of the key plug. The ability to remove the key at various positions is necessary for most switch type lock applications.

SUMMARY OF THE PRESENT INVENTION

The present invention overcomes the above-discussed disadvantages and other deficiencies of the prior art by providing a novel and improved cylinder lock.

A cylinder lock in accordance with the present invention has a key plug which is normally engaged within a cylinder. This cylinder lock incorporates one locking mechanism. This locking mechanism, in a preferred embodiment, is comprised of a locking bar which is slidably mounted within a lateral slot in the key plug. This locking bar has a cam-like protrusion which extends past the shear line into a notch provided within the cylinder wall. This engagement of the plug locking bar with the cylinder normally prevents the plug from rotating within the cylinder. The improved cylinder lock of the present invention further incorporates a unique release mechanism which allows the cam-like extension of the locking bar to be cammed out of the notch.

The above-mentioned release mechanism utilizes a novel double-tumbler system. The first tumblers of this double-tumbler system consist of flat sliding bar tumblers. These bar tumblers are positioned beneath the locking bar in a crosswise fashion. This allows the upper edge of the bar tumblers to slide beneath the bottom edge of the locking bar. The portion of the locking bar beneath which the tumblers slide is provided with extensions or lugs. The upper edge of each bar tumbler is provided with at least one notch which is termed the true gate. This true gate is dimensioned so that it may receive the cooperating lug of the locking bar when positioned beneath it. The release mechanism usually incorporates a series of these bar tumblers which are provided with true gates at differing locations within their upper edges. When all of the true gates are aligned beneath the appropriate lug the locking bar may be cammed out of the cylinder notch by rotating the key plug within the cylinder. A pair of locking bar springs normally bias the locking bar into the cylinder notch even when the lugs and true gates are aligned. By providing the cylinder notch with angled walls, the rotation of the key plug cams the locking bar out of the notch and into the true gates against the biasing effect of springs. This allows the turning of the key plug.

In accordance with the preferred embodiment of the present invention, the above-discussed bar tumblers are slidably mounted within channels provided within the key plug. The sliding motion of each of the bar tumblers is controlled by the interaction between a biasing spring and a pin tumbler. The bar tumblers are each provided, at a first end, with a first extension or arm which is perpendicular to a plane defined by the bar tumbler, this plane being transverse to the axis of the cylinder. At their other ends, the bar tumblers are provided with a second extension or leg which lies within the same plane as the bar tumbler. These second extensions have an angular relationship to the bottom edge of the bar tumbler. The key plug is provided with a series of holes within its body. The holes of this series are aligned in two rows on opposite sides of the key plug. The holes of the upper row are "blind" while the holes of the lower row are open at both ends, the inner ends being in communication with the keyway. The rows of holes on each side of the key plug are not in alignment with each other but have an alternating alignment of upper and lower holes. The two rows of holes on the opposing sides of the key plug are positioned so that one upper hole on one side is partially in alignment with a lower hole on the opposing side. These two partially aligned holes are interconnected by a channel which receives a bar tumbler. A bar tumbler biasing spring is positioned within each of the "blind" holes and a pin tumbler is positioned within each of the lower holes. The first extensions of the bar tumblers are positioned within the upper holes so that the springs are compressed between these first extensions of the bar tumbler and the bottoms of the holes. This biases the first extentions of the bar tumblers out of the key plug holes. The second extensions of the bar tumblers extend into the lower holes and contact first ends of the pin tumblers. The biasing force of the springs is transferred to the pin tumblers through the bar tumblers. This normally biases the pin tumblers into the keyway. The second ends of the pin tumbler; i.e., the ends which project into the keyway have a conical shape.

Normally, the true gates of the bar tumblers are not in alignment with the lugs of the locking bar. When a KABA type key is inserted within the keyway the pin tumblers are urged outward against the legs of the bar tumblers thereby urging the bar tumbler second extensions against the biasing springs. This action causes the bar tumblers to slide within the channels. By providing the key with a plurality of circular bits that have appropriate depths, the pin tumblers move outwardly and then inwardly such that their final position will result in the true gates of the bar tumblers being located beneath the lugs of the locking bar. When all of the pin tumblers are moved outwardly the appropriate distance, the true gates of all the bar tumblers are positioned beneath the lugs of the locking bar. The key plug may be then turned to cam out the cam-like protrusion of the locking bar from the cylinder notch.

The pin and bar tumblers are all alike with the key changes being determined by the positioning of the true gates on the upper edge of the bar tumblers. Accordingly, the manufacture of only one size pin tumbler and only one size bar tumbler is required thereby reducing manufacturing difficulties and costs. The locking bars are also identical with the lugs arranged in only one position. The true gate may be provided within the bar tumbler after it is formed. This allows for easy repair of the lock assembly since the old bar tumbler may be aligned with a new bar tumbler and the appropriate true gate cut within the upper edge of the new tumbler. This allows the stocking of only one size of bar and pin tumblers which further reduces the overall cost of the use of this novel and improved cylinder lock. Furthermore, this novel and improved cylinder lock is difficult to tamper with even if the key plug is minutely rotatable due to manufacturing tolerances. With prior art cylinder locks which utilize pin tumblers, if the key plug is turned a ledge is created at the shear line which catches the drivers. These prior art locks allowed a simple method of unauthorized opening of the cylinder lock. With the present invention there are no drivers to be caught and no ledges to be formed. The present invention may be further protected from tampering by providing the bar tumblers with at least one false gate. This false gate is a notch within the upper edge of the bar tumbler which does not fully engage the lug of the locking bar. The false gate is positioned before the true gate and creates a false engagement to one tampering with the lock. This makes the locating of the true gate more difficult.

The present invention has, as one of its objects, the provision of a novel and improved cylinder lock which is highly resistant to defeat.

Another object of the present invention is the provision of an improved and novel cylinder lock characterized by reduced manufacturing cost when compared to the prior art.

Still another object of the present invention is the provision of a novel and improved cylinder lock of th KABA type which is of reduced size whereby it can be used in most existing lock configurations.

Yet another object of the present invention is the provision of a novel and improved cylinder lock which uses a standard KABA type key with no sharp edges or corners.

A further object of the present invention is the provision of an improved cylinder lock characterized by the ability to remove the key at various locations.

BRIEF DESCRIPTION OF THE DRAWING

The present invention may be better understood and its numerous objects and advantages will be apparent to those skilled in the art by reference to the accompanying drawings, wherein like reference numerals refer to like elements in the several figures, in which.

DESCRIPTION OF THE PREFERRED EMBODIMENT

Figure 1:
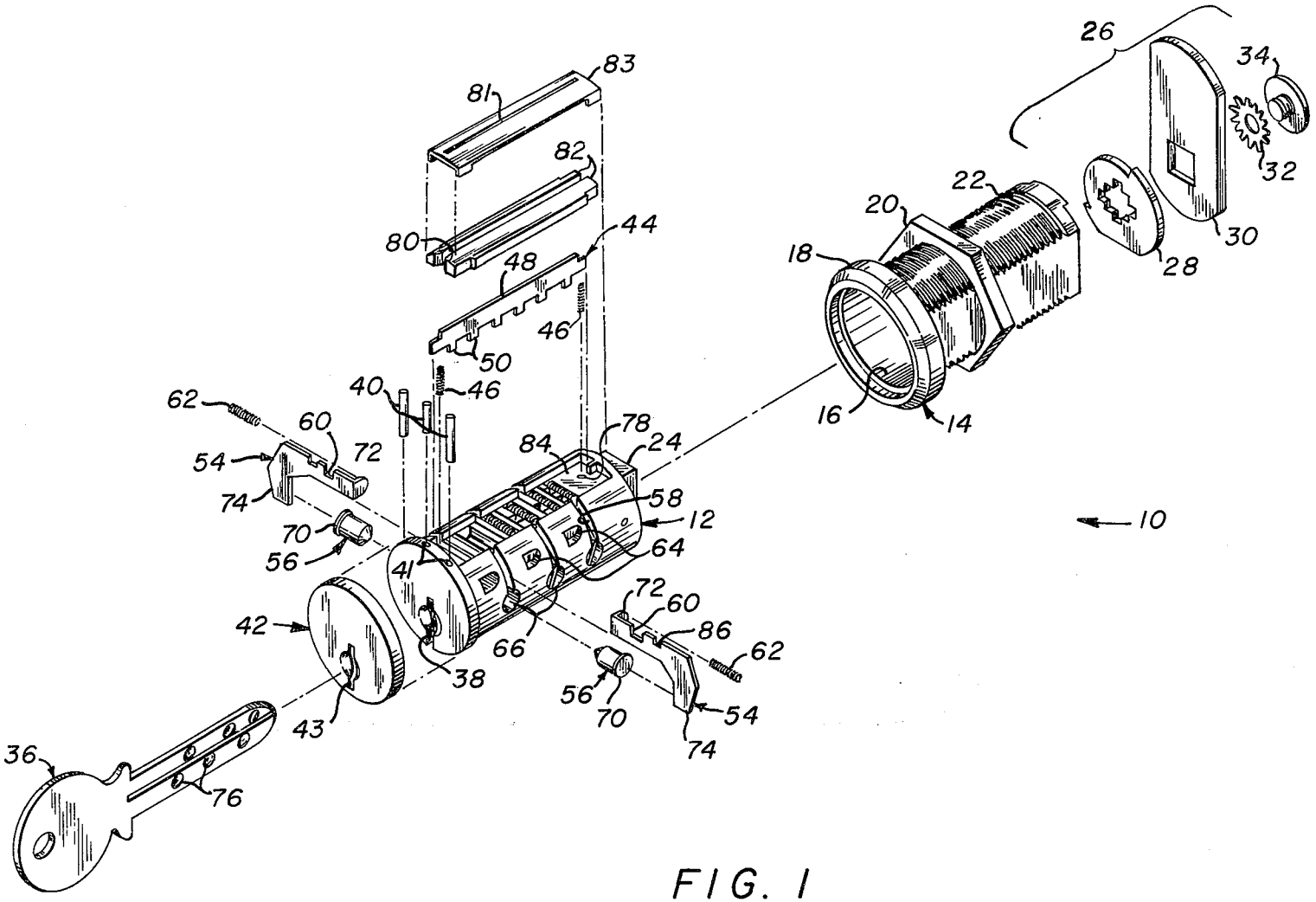
FIG. 1 is an exploded perspective view of the preferred embodiment of a cylinder lock according to the present invention with its key.

Referring to FIG. 1 an exploded view of a cylinder lock in accordance with the preferred embodiment of the present invention is indicated generally at 10. Cylinder lock 10 is generally comprised of key plug 12 and cylinder 14. Cylinder 14 is provided with bore 16 which is capable of receiving key plug 12. The remaining structure of cylinder 14 includes collar 18, cylinder nut 20 and external threads 22. The construction of cylinder 14 is well known in the art and it should be understood that while FIG. 1 illustrates the preferred embodiment any type of conventional cylinder arrangement is suitable. This includes mortise type cylinders, rim type cylinders, electric switch type cylinders, automobile ignition lock type cylinders, padlocks, etc.

Key plug 12 is rotably mounted within bore 16 of cylinder 14. Key plug 12 is provided with first and second ends. The first end of key plug 12 is inserted first into bore 16 and is provided with stud 24. The second end of the key plug 12 is provided with keyway 38. Keyway 38 is an internal cavity and preferably a lateral slot. Keyway 38 is capable of receiving key 36. Stud 24 rotates with key plug 12 and may be associated with any conventional mechanism such as, for example, cam assembly 26. Stud 24 may also be associated with other mechanisms such as door bolt retracting mechanisms, auto ignition switches, etc. Cam assembly 26 is comprised of quarter turn washer 28, camming arm 30, lock washer 32 and screw 34. This arrangement is well known in the art and will not be discussed further herein.

Preferably, the second or forward end of key plug 12 is provided with a plurality of blind holes each of which receives a hardened pin 40. These hardened pins 40 impede the drilling of key plug 12 pursuant to the unauthorized opening of cylinder lock 10. It is to be noted that pins 40 are not an essential element of the invention. While hardened pins 40 are preferred, alternate drill impeding structures, a hardened disc for example, may be provided. It is further preferable to cover the second or key receiving end of key plug 12 with a plug cap which is indicated generally at 42. Cap 42 captures the hardened pins 40 within the holes provided therefor in key plug 12. Cap 42 is provided with slot 43 which aligns with keyway 38.

Figure 2:
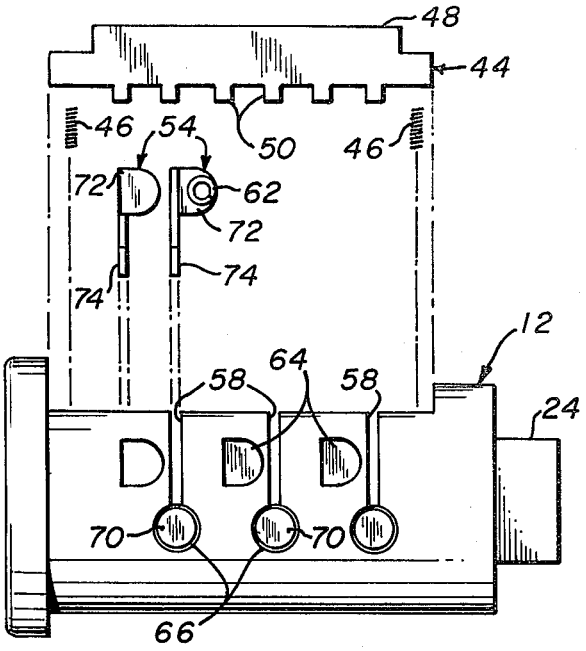
FIG. 2 is an exploded side view of the key plug of the embodiment of FIG. 1.

Referring jointly to FIGS. 1 and 2, the key plug 12 of cylinder lock 10 will now be described. Key plug 12, which is rotatably mounted within bore 16, is normally prevented from rotating by a locking mechanism. This locking mechanism is comprised of locking bar 44 and locking bar biasing springs 46. Springs 46 are positioned beneath locking bar 44 within blind holes 78 provided within the body of key plug 12. Locking bar 44 is preferably of a generally rectangular shape with a top and bottom edge. Locking bar 44 is slidably mounted within lateral slot 80. Preferably, slot 80 is provided within a locking bar support 82 which is distinct from key plug 12. Support 82 is received in a bar support compartment or recess 84 which is provided within key plug 12. Support 82 is covered with retainer plate 83 which prevents the movement of support 82 when key plug 12 is within bore cylinder 16. Plate 83 is affixed to the body of cylinder 12, for example by staking, and is provided with slit 81 which is aligned with lateral slot 80. Support 82 is also preferably constructed in two sections in order to allow easy placement within compartment 84. The upper edge of locking bar 44 is provided with an elongated cam-like extension 48 and the opposite edge of bar 44 is provided with a plurality of lugs 50. Cam-like extension 48 is normally received within a cam notch 52, which may best be seen from FIGS. 4A and 4B, which is provided within the bore 16 of cylinder 14. Cam-like extension 48 can be disengaged from cam notch 52 by a releasing mechanism which is operated by key 36. Cam extension 48 is normally maintained within notch 52 by the biasing action of springs 46. By providing notch 52 with outwardly sloped walls; i.e., by employing a V-shaped notch; extension 48 may be camed out of notch 52 against the biasing force of springs 46 by rotating key plug 12 (as seen in FIG. 4B) after insertion of the proper key in keyway 38.

The releasing mechanism of the present invention is comprised of a dual in-line tumbler system. This tumbler system incorporates cooperating pairs of flat bar tumblers 54 and pin tumblers 56. Bar tumblers 54 are slidably mounted beneath locking bar 44, and in a crosswise orientation with respect to bar 44, within slots 58 formed in key plug 12. Bar tumblers 54 have first and second oppositely disposed edges and define planes which are generally transverse to the plane defined by locking bar 44. The first edges of bar tumblers 54 are positioned beneath lugs 50 of locking bar 44. This allows a portion of the first edge of each bar tumbler 54 to slide beneath a lug 50.

Lugs 50 of locking bar 44 each normally contact the first edge of a bar tumbler 54. This arrangement, in cooperation with the biasing action of springs 46, prevents cam-like extension 48 of bar 44 from being disengaged from cylinder notch 52. The first edges of bar tumblers 54 are each provided with a true gate 60. True gate 60 is sized so as to be capable of receiving a lug 50. By sliding bar tumblers 54 within channels 58, true gates 60 may be aligned with lugs 50. The rotation of key plug 12 within cylinder 14 cams extension 48 of bar 44 out of cam notch 52 if all of the tumblers 54 are properly positioned, and, in so doing forces lugs 50 into true gates 60 by driving bar 44 against the biasing force of springs 46. When extension 48 is again aligned with cylinder notch 52, springs 46 bias the extension 48 into notch 52 and lugs 50 out of true gates 60.

The positioning of each bar tumbler 54 within a slot 58 is controlled by a pin tumbler arrangement including a tumbler spring 62 and by a pin tumbler 56 which cooperates with key 36. Tumbler springs 62 and pin tumblers 56 are respectively removably mounted within bores 64 and 66 of key plug 12. Spring receiving bores 64 and pin tumbler receiving bores 66 are provided within key plug 12 by any known method, such as by drilling. Bores 64 are blind holes. Pin tumbler receiving bores 66 extend from the exterior of key plug 12 into keyway 38. Pin tumbler bores 66 are further provided with internal shoulders 68, FIGS. 4A and 4B, which restricts the reciprocating movement of pin tumblers 56 in a first direction by engaging outwardly extending flanges defined by the base of cap portions 70 of pin tumblers 56. In the preferred embodiment of the present invention the spring receiving bores 64 are aligned in rows which are offset with respect to pin tumbler bores 66 which are also aligned in rows. These offset rows the spring bores 64 and pin tumbler bores 66 are provided on opposing sides of key plug 12 whereby the bores 66 intersect the keyway from a pair of opposite directions. Spring receiving bores 64 and pin tumbler bores 66 are also preferably arranged on each side of key plug 12 in a zigzag fashion which may best be seen from FIG. 2. This arrangement partially aligns each spring receiving bore 64 with a pin tumbler bore 66 on the opposite side of key plug 12. These partially aligned holes are interconnected by the slots 58 in which the bar tumblers move.

Bar tumblers 54 are provided, at first ends, with extension arms 72 which project laterally into spring receiving bores 13. Tumblers 54, at their opposite ends, have projections 74 which are received in pin tumbler bores 66. Arms 72 are biased in the outward direction with respect to plug 12 by tumbler springs 62 and thus projections 74 are biased in the inward direction. Projections 74 preferably lie within the same plane as the bar tumblers 54 with which they are integral and projections 74 are angularly related to the body of tumblers 54 as clearly shown in FIGS. 4A and 4B. A first side of each of projections 74 contacts a cap portion 70 of a pin tumbler 56 with which it cooperates. Normally the biasing force of tumbler spring 62 upon arm 72 of a bar tumbler 54 causes projection 74 to urge its associated pin tumbler 56 into a pin tumbler receiving bore 66 until the flange at the base of the pin tumbler cap 70 engages a ledge 68. Thus, the tips of pin tumblers 56 are spring biased into keyway 38. Preferably, the tips of pin tumblers 56 have a conical shape.

Figure 3:
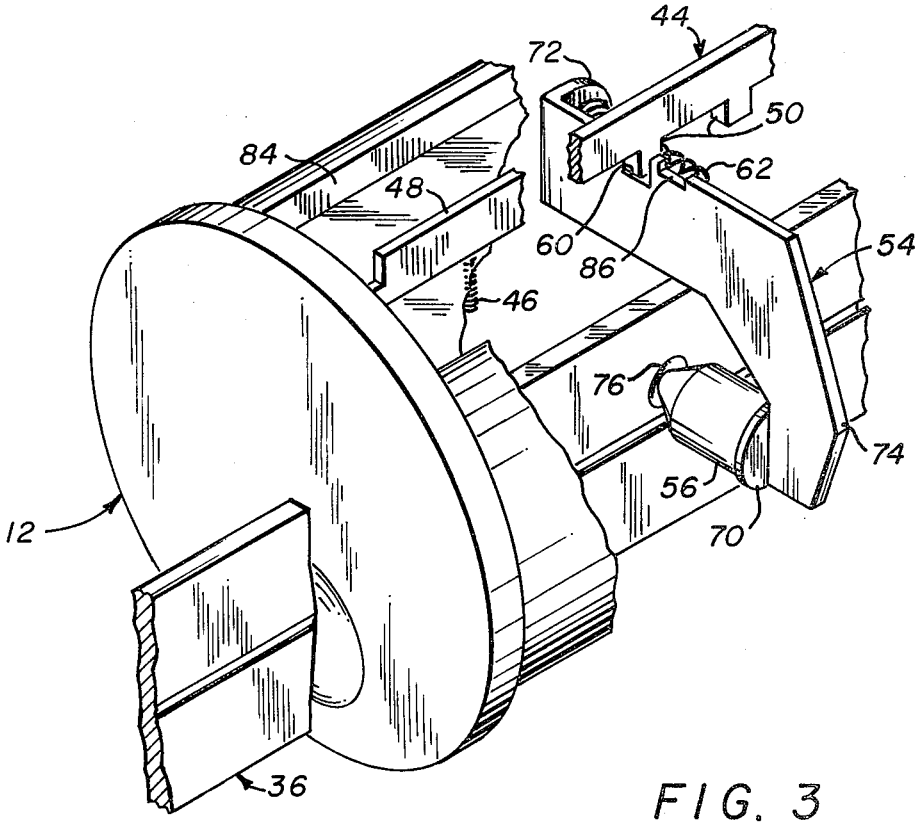
FIG. 3 is a partial perspective and enlarged view of the key plug of the lock of FIGS. 1 and 2 with portions being broken away to expose the flat bar tumbler and pin tumbler arrangement beneath the locking bar.
Figure 4A:
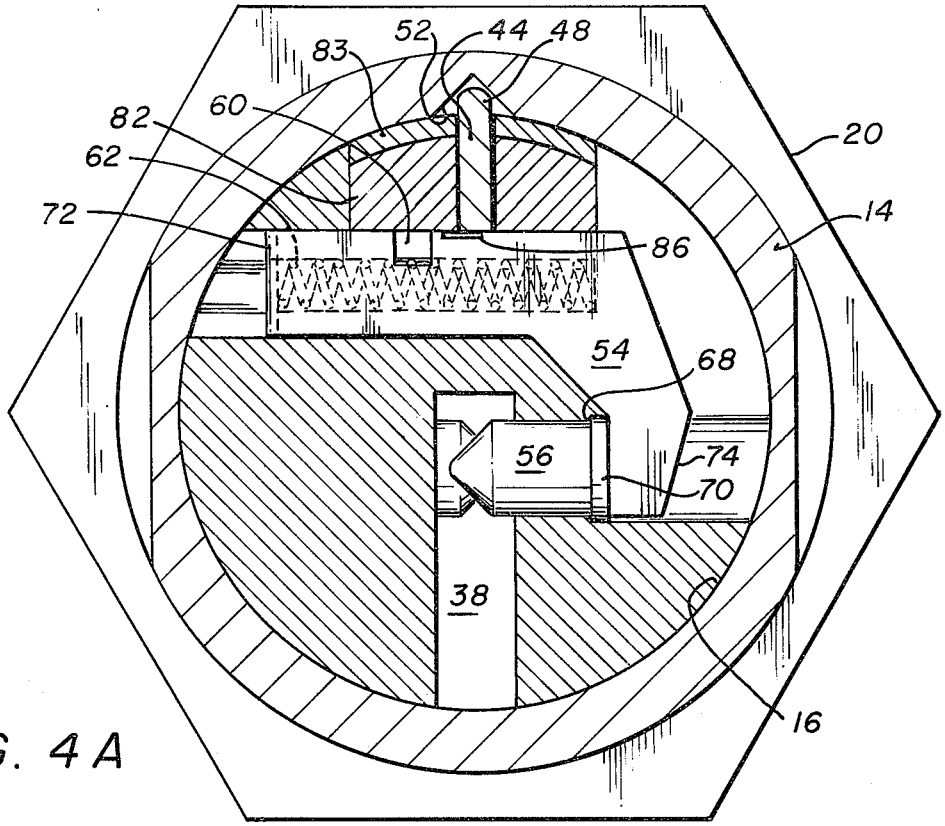
FIGS. 4A and 4B are cross-sectional views of the assembled lock, taken along line 4—4 of FIG. 2, respectively depicting the lock in the locked and unlocked conditions.
Figure 4B:
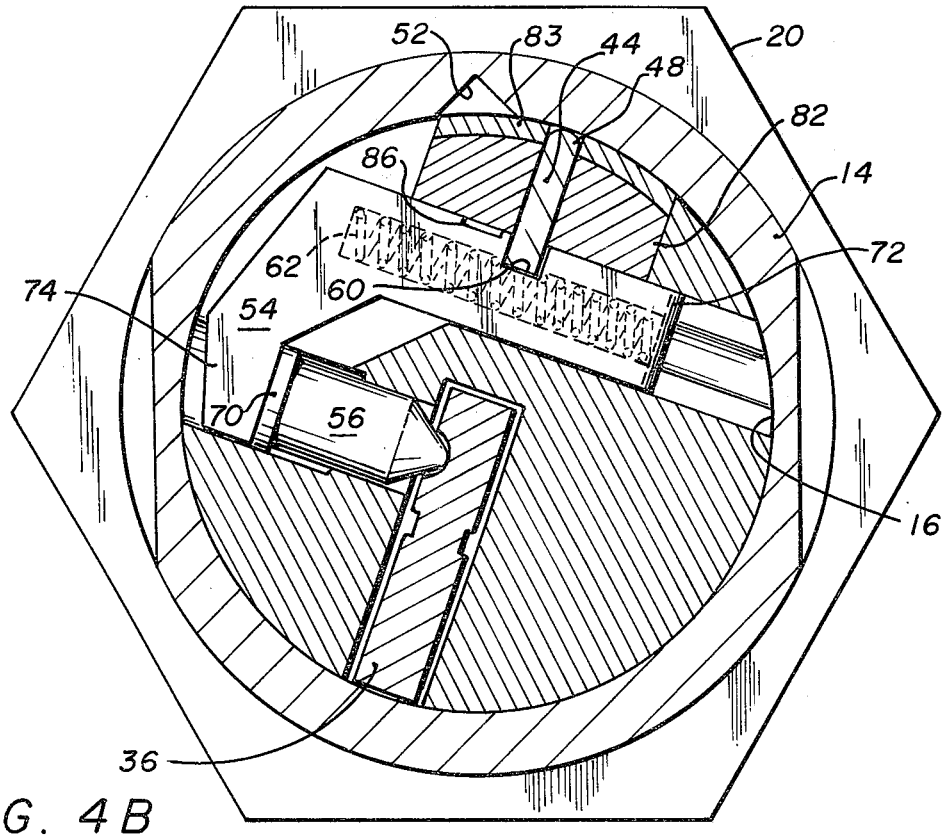

Referring now to FIGS. 3, 4A and 4B, the operation of cylinder lock 10 will now be described. In the normal or locked state of the lock, depicted in FIG. 4A, the cam-like extension 48 of bar 44 is positioned within cam notch 52 of cylinder 14. Cam-like extension 48 is prevented from disengaging cam notch 52; i.e., moving toward the axis of the lock; by the first edge of bar tumblers 54. Cylinder lock 10 is operated by the insertion of key 36 into keyway 38. Key 36 is provided on its opposing surfaces with cylindrical or conical detents 76, hereinafter referred to as bits, as shown. The bits 76 are sized, shaped and positioned to receive the tips of pin tumblers 56. The depth of each bit 76 is such that, when the cooperating pin tumbler 56 moves into the bit under the influence of its biasing spring 62, the corresponding bar tumbler 54 will slide within a channel 58 and the true gate 60 of tumbler 54 will be aligned under a lug 50 on locking bar 44. By providing key 36 with the proper number and dimensioned conical detents 76, each pin tumbler 56 within key plug 12 is moved sufficiently to align all of the true gates 60 under lugs 50. At this time, by turning key 36, cam-like extension 48 may be cammed out of cam notch 52 as illustrated in FIG. 4B. Locking bar springs 46 retain cam-like extension 48 within cam notch 52 until key plug 12 is rotated within cylinder 14.

In order to provide cylinder lock 10 with an additional safety feature the first edges of bar tumblers 54 may be provided with at least one false gate 86. False gates 86 are of a smaller size than true gates 60 and are positioned within the first edges of bar tumblers 54 before the true gates 60. False gates 86 give the impression of releasing mechanism activation by allowing slight engagement with lugs 50 without allowing extension 48 from being cammed out of notch 52.

It it is desired to remove the key at various locations, the cylinder 14 will be provided with additional V-grooves at the desired locations. This key removal ability, particularly in combination with the small size of the lock, makes it particularly well suited for use as a switch lock.

Locks in accordance with the present invention are of reduced size, when compared to the prior art, partly because the entire locking mechanism is contained within the key plug. This feature also permits this lock to be substituted for presently available cam locks, switch locks, auto ignition locks, key-in-knob locks, etc.

The locks of the present invention, by virtue of their use of the side bar principle, are highly pick-resistant. The present locks, as noted above, require few parts which can be produced at minimum expense. This results in a lock which can be manufactured at a comparatively low cost.

While a preferred embodiment has been described and illustrated various modifications and substitutions may be made thereto without departing from the spirit and scope of the invention. Accordingly, it is to be understood that the present invention has been described by way of illustration and not limitation.

What is claimed is:

1. A cylinder lock operated by a key having detents of differing depths provided within its opposing surfaces comprising:

cylinder housing means;

key plug means rotatably mounted within said cylinder housing means, said key plug means being provided with a keyway;

at least one tumbler means, said tumbler means being reciprocally mounted in said key plug means, said tumbler means being normally biased into said keyway, said tumbler means being directed out of said keyway upon engagement with a detented key, said tumbler means position being determined by the depth of the key detent with which it is engaged;

at least one bar means, said bar means being slidably mounted in said key plug, said bar means being biased in a first direction, said bar means being in contact with said tumbler means, said bar means being moved in a second direction opposite to said first direction by said tumbler means when said tumbler means engages the detented key;

first biasing means for biasing said tumbler means in said first direction;

fence means, said fence means being reciprocally mounted in said key plug means, said fence means being biased in a third direction generally transverse to said first direction to engage said cylinder housing means and prevent the rotation of said key plug means, said fence means contacting a portion of said bar means which prevents said fence means from moving in a fourth direction opposite to said third direction when the lock is in the locked condition;

true gate means, said true gate means being provided in said bar means portion, said true gate means being placed in alignment with said fence means when said bar means is moved to the unlocked position by reception of said plug means in a key detent of proper depth, said true gate means receiving said fence means and allowing said fence means to move in said fourth direction and disengage from said cylinder housing means; and second biasing means for biasing said fence means in said third direction.

2. The cylinder lock of claim 1 wherein said first biasing means resiliently biases said bar means in said first direction and said bar means biases said tumbler means into said keyway.

3. The cylinder lock of claim 2 wherein bar means is comprised of:

a first section, said first section contacting a first end of said tumbler means;

a second section, said second section means being integral with said first section, said second section extending generally transversely of said first section and being provided with said true gate means; and a third section, said third section being integral with said second section, said third section extending generally transversely of said second section and contacting said first biasing means.

4. The cylinder lock of claim 3 wherein said first biasing means is a spring.

5. The cylinder lock of claim 4 wherein said bar means first, second and third sections are flat.

6. The cylinder lock of claim 1 wherein said tumbler means is a pin tumbler having a flat second end which is engaged by said bar means.

7. The cylinder lock of claim 1 wherein said second biasing means comprises at least a first spring.

8. The cylinger lock of claim 5 wherein said tumber means is a pin tumbler having an axis and a first end shaped to be complementary to the key detent in which it is to be received, said pin tumber second end being flat and adapted to be engaged by said bar means third section.

9. The cylinder lock of claim 1 further comprising:

false gate means, said false gate means being provided in said bar means portion, said false gate means partially receiving said fence means and allowing said fence means to move in said second direction but not disengage from said cylinder housing.

10. The cylinder lock of claim 1 wherein said fence means comprises:

a flat elongated body portion, a first edge of said body portion engaging an elongated slot in said cylinder housing means; and lug means extending from said body, said lug means contacting said bar means portion.

11. The cylinder lock of claim 5 wherein said fence means comprises:

a flat elongated portion, a first edge of said body portion engaging an elongated slot in said cylinder housing means; and lug means extending from said body portion, said lug means contacting said bar means second station.

12. The cylinder lock of claim 8 wherein said fence means comprises:

a flat elongated body portion, a first edge of said body portion engaging an elongated slot in said cylinder housing means; and lug means extending from said body portion, said lug means contacting said bar means second section.

13. The cylinder lock of claim 12 further comprising:

false gate means, said false gate means being provided in said bar means second section, said false gate means partially receiving said fence means lug means and allowing said fence means lug means to move in said second direction but not disengage from said cylinder housing.

14. A lock comprising:

tumbler housing means, said housing means having at least a first groove therein;

plug means, said plug means being positioned within said housing means for rotation relative to said housing means, said plug means being provided with an elongated keyway, said plug means having a plurality of openings therein, some of said openings being oriented transversely with respect to said keyway, at least some of said transverse openings intersecting said keyway, at least a further of said openings being oriented generally parallel to said keyway and intersecting some of said transverse openings;

tumbler means, said tumbler means being reciprocally mounted in at least first of said plug means transversely oriented openings;

bar means, said bar means being slidably mounted in at least second of said plug means transversely oriented openings, said bar means contacting respective of said tumbler means, said bar means each further having a first irregularly shaped edge;

first resilient biasing means, said first biasing means being positioned within at least third of said plug means transversely oriented openings and in contact with said plug means and said bar means, said first biasing means causing said bar means to slide in a first direction, movement of said bar means being transmitted to said tumbler means whereby said tumbler means will extend partly into said keyway;

fence means, said fence means being slidably positioned in an opening in said plug means which is generally parallel to said keyway, a first edge of said fence means extending into the said plug means openings in which said bar means are disposed and into contact with said bar means first edges, said fence means first edge being provided with irregularities, said fence means and bar means first edges cooperating to selectively permit or prevent movement of said fence means toward and away from said housing means, a second edge of said fence means normally engaging said housing means groove to prevent rotation of said plug means; and second resilient biasing means for urging said fence means toward said housing means, said second biasing means being disposed with at least another opening in said plug means.

15. The lock of claim 14 wherein said tumbler means each comprises:

a cylindrical body portion;

a first end portion extending from said body portion and tapering toward the axis of the cylinder defined thereby, said first end portion being shaped to be received within a detent in a key inserted in said plug means keyway; and a second end portion, said second end portion engaging said bar means whereby said bar means will be caused to move transversely relative to said fence means a distance determined by the depth of the key detent upon insertion of a key into said keyway.

16. The lock of claim 15 wherein said bar means each comprise:

a flat elongated body portion, said body portion having said first edge on the side thereof positioned closest to said housing means;

a first end portion extending generally transversely of said body portion said first end portion contacting said tumbler means second end portion; and a second end portion, said second end portion extending generally transversely of said body portion and in a direction generally transverse to the direction of said first end portion, said second end portion engaging said first biasing means.

17. The lock of claim 14 wherein said tumbler means are mounted in said plug means for reciprocation in two opposite directions, said tumbler means extending into said keyway from a pair of opposed sides thereof.

18. The lock of claim 16 wherein said tumbler means are mounted in said plug means for reciprocation in two opposite directions, said tumbler means extending into said keyway from a pair of opposed sides thereof.

19. The lock of claim 14 wherein said plug means comprises:

a body portion, said body portion defining said keyway, said body portion being provided with tumbler receiving holes extending from the outside to said keyway, said body portion further being provided with bar means receiving slots extending generally parallely to said tumbler receiving holes, said body portion additionally being provided with plural recesses for receiving said first biasing means, said body portion also having a peripheral recess, said peripheral recess communicating with said bar means receiving slots and said plural recesses; and cap means, said cap means being received in said peripheral recess and defining said fence means receiving slot.

* * * * *